US010406771B2

(12) United States Patent
Henry

(10) Patent No.: US 10,406,771 B2
(45) Date of Patent: Sep. 10, 2019

(54) METHOD AND APPARATUS FOR PRODUCING PLASTIC BAGS

(71) Applicant: Miller Weldmaster Corporation, Navarre, OH (US)

(72) Inventor: Brian D. Henry, North Lawrence, OH (US)

(73) Assignee: Miller Weldmaster Corporation, Navarre, OH (US)

( * ) Notice: Subject to any disclaimer, the term of this patent is extended or adjusted under 35 U.S.C. 154(b) by 434 days.

(21) Appl. No.: 15/176,776

(22) Filed: Jun. 8, 2016

(65) Prior Publication Data

US 2017/0355163 A1 Dec. 14, 2017

(51) Int. Cl.

| | |
|---|---|
| ***B31B 70/64*** | (2017.01) |
| ***F24H 3/02*** | (2006.01) |
| ***B31B 70/00*** | (2017.01) |
| ***B31B 70/92*** | (2017.01) |
| ***B31B 70/26*** | (2017.01) |
| ***B31B 70/74*** | (2017.01) |
| *B31B 150/00* | (2017.01) |
| *B31B 170/10* | (2017.01) |

(52) U.S. Cl.

CPC ..... *B31B 70/64* (2017.08); *B31B 70/00* (2017.08); *B31B 70/266* (2017.08); *B31B 70/76* (2017.08); *B31B 70/92* (2017.08); *F24H 3/02* (2013.01); *B31B 2150/001* (2017.08); *B31B 2170/10* (2017.08)

(58) Field of Classification Search

CPC ..... B31B 70/00; B31B 70/266; B31B 70/92; B31B 70/76; B31B 70/14; B31B 70/26; B31B 70/62; B31B 70/64; B31B 2170/00; F24H 3/02

USPC ..... 493/239, 248, 264, 262, 246, 223

See application file for complete search history.

(56) References Cited

U.S. PATENT DOCUMENTS 3,508,374 A * 4/1970 Bertoglio Guido ..... B29C 65/02 383/104
3,720,565 A * 3/1973 Cavanna ..... B29C 65/10 156/308.2
4,175,478 A * 11/1979 Tripler ..... B42C 7/00 493/248
4,534,752 A * 8/1985 Ferrell ..... B31B 70/00 493/213

(Continued)

OTHER PUBLICATIONS

Rolf Klein, Material Properties of Plastics, 2011, Wiley-VCH GmbH & Co. KGaA (Year: 2011).*

*Primary Examiner* — Hemant Desai
*Assistant Examiner* — Christopher Robin Kim
(74) *Attorney, Agent, or Firm* — Sand, Sebolt & Wernow Co., LPA

(57) ABSTRACT

A gusset preheating assembly and a method of using the same. The assembly includes a heating gun assembly mounted on a frame. Spreader rods open up a gap in a bag's gusset and nozzles blow warmed air into the gap. Orthogonally arranged first and second hydraulic members are operatively engaged with heating gun assembly and are activated to move the heating gun assembly vertically or horizontally. Hot air blowing into the gap from the nozzle relaxes the gusset. Pressure is applied to the relaxed gusset, thereby reducing the thickness of the gusset region of the bag. The reduction in thickness makes it possible to increase the number of gusseted bags that are packaged in a container or on a roll.

9 Claims, 8 Drawing Sheets

(56) References Cited

U.S. PATENT DOCUMENTS

| | | | | |
|---|---|---|---|---|
| 5,102,384 | A * | 4/1992 | Ross | B31B 70/00 493/243 |
| 5,147,272 | A * | 9/1992 | Richison | B65D 33/2533 493/195 |
| 6,170,238 | B1 * | 1/2001 | Lerner | B65B 43/123 198/626.1 |
| 6,254,520 | B1 * | 7/2001 | Angless | B65C 9/2217 493/226 |
| 10,265,484 | B2 * | 4/2019 | Stuart | A61M 15/0026 |
| 2001/0002938 | A1 * | 6/2001 | Totani | B65D 31/10 383/120 |
| 2004/0258332 | A1 * | 12/2004 | Totani | B65D 31/10 383/120 |
| 2005/0272583 | A1 * | 12/2005 | Totani | B31B 70/00 493/162 |
| 2007/0120312 | A1 * | 5/2007 | Trovinger | B65H 37/04 270/58.07 |
| 2008/0298728 | A1 * | 12/2008 | Bierschenk | B65D 75/326 383/120 |
| 2010/0025429 | A1 * | 2/2010 | Ager | B65B 9/20 222/92 |
| 2012/0160732 | A1 * | 6/2012 | Tan | B65D 33/001 206/554 |
| 2013/0022295 | A1 * | 1/2013 | Shapiro | B65D 31/10 383/203 |
| 2016/0136930 | A1 * | 5/2016 | Gregard | B32B 17/10036 359/275 |
| 2018/0155085 | A1 * | 6/2018 | Tiepelman | B31B 70/18 |
| 2018/0236741 | A1 * | 8/2018 | Hargett | B31B 70/146 |

* cited by examiner

METHOD AND APPARATUS FOR PRODUCING PLASTIC BAGS

BACKGROUND OF THE INVENTION

Technical Field

The present disclosure relates generally to a system for fabricating polypropylene (plastic) bags, particularly biaxially oriented polypropylene (BOPP) bags. Specifically, the present disclosure is directed to a system and machine for fabricating polypropylene bags that includes a gusset preheating assembly provided on either side of an area where the bags are fabricated; the preheating assembly includes heating gun assemblies that blow warmed air into gussets on the bags thereby relaxing those gussets, and rollers that apply pressure thereto so that the so-formed gusseted bags take up less room when they are subsequently cut or rolled and then packaged.

Background Information

Polypropylene bags may be fabricated by weaving and laminating extruded polypropylene, particularly BOPP threads into a sheet that is wound onto a roll. During production, the sheet is progressively unrolled from the roll and passes into machinery that folds regions of the sheet to form gussets and then heat seals the bottom and sides of the bag and then cuts individual bags from the sheet. Other steps such as printing on the exterior of the bags, forming handles etc. may also occur during this fabrication process. The cut bags may then be stacked and packaged together for subsequent shipping to a customer. In other instances, instead of cutting the individual bags from the roll, after gussets have been formed in sheet, the gusseted sheet may be wound onto a second roll for subsequent processing.

Having gussets on a bag allows the bag to open wider so that it is able to hold more materials inside of it. However, having gussets also makes the thickness of a bag uneven across its width because the side portions of the bag are thicker than a central region thereof. Because of this increased thickness and stiffness on the sides of the bags, a stack of gusseted bags or a roll of gusseted bags tends to takes up more space than a stack or roll of ungusseted bags.

SUMMARY

There is a need in the art to provide a process and assembly for fabricating gusseted bags and that decreases the overall thickness of the gusseted bags across their width and thereby reduces the overall space a stack or roll of gusseted bags will occupy.

A gusset preheating assembly and a method of using the same is therefore disclosed herein The assembly includes a frame, a heating gun assembly mounted for movement with respect to the frame; said heating gun assembly including a nozzle that is used to heat a gusset of a bag that is fed through the gusset preheating assembly. The assembly also includes a first hydraulic member and a second hydraulic member mounted on the frame and being operatively engaged with each heating gun assembly. The first and second hydraulic members are oriented at right angles to each other and are selectively activated to move a portion of the heating gun assembly vertically or horizontally with respect to the frame. The movement of the heating gun assembly causes the nozzle to be inserted into a gap in a gusset or removed therefrom. Hot air is blown into the gap from the nozzle, the gusset is allowed to cool as it passes through press-rollers and this causes gusseted regions of the bag to relax and form a crisper crease, thereby reducing in thickness and tending to reduce the sign of the gap between the layers of the gussets. The relaxation of the gussets and possible reduction in thickness makes it possible to increase the number of gusseted bags that are packaged in a container or on a roll.

In one aspect the invention may provide a gusset preheating assembly comprising a frame; and a heating gun assembly including a nozzle that is adapted to heat a gusset of a bag that is fed through the gusset preheating assembly. The nozzle may be mounted for movement with respect to the frame.

In another aspect, the invention may provide a gusset preheating assembly that further includes a first hydraulic member mounted on the frame and being engaged with the heating gun assembly; said first hydraulic member being selectively operable to move at least a portion of the heating gun assembly in a first direction towards the gusset or in a second direction away from the gusset; and a second hydraulic member mounted on the frame and being engaged with the heating gun assembly, said second hydraulic member being selectively operable to move at least a portion of the heating gun assembly in a first direction toward the gusset or in a second direction away from the gusset; and where the first hydraulic member and the second hydraulic member are oriented at right angles relative to each other and are operable to move the heating gun assembly in directions that are at right angles to each other.

In yet another aspect, the invention may provide a method of producing plastic bags, said method comprising the steps of forming a gusset in each of two opposing sides of a plastic sheet; passing the gusseted sheet into a gusset preheating assembly; heating the gussets with a heating gun assembly; relaxing the gussets; and feeding the sheet with the relaxed gussets into a cutting operation or into a rolling operation.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
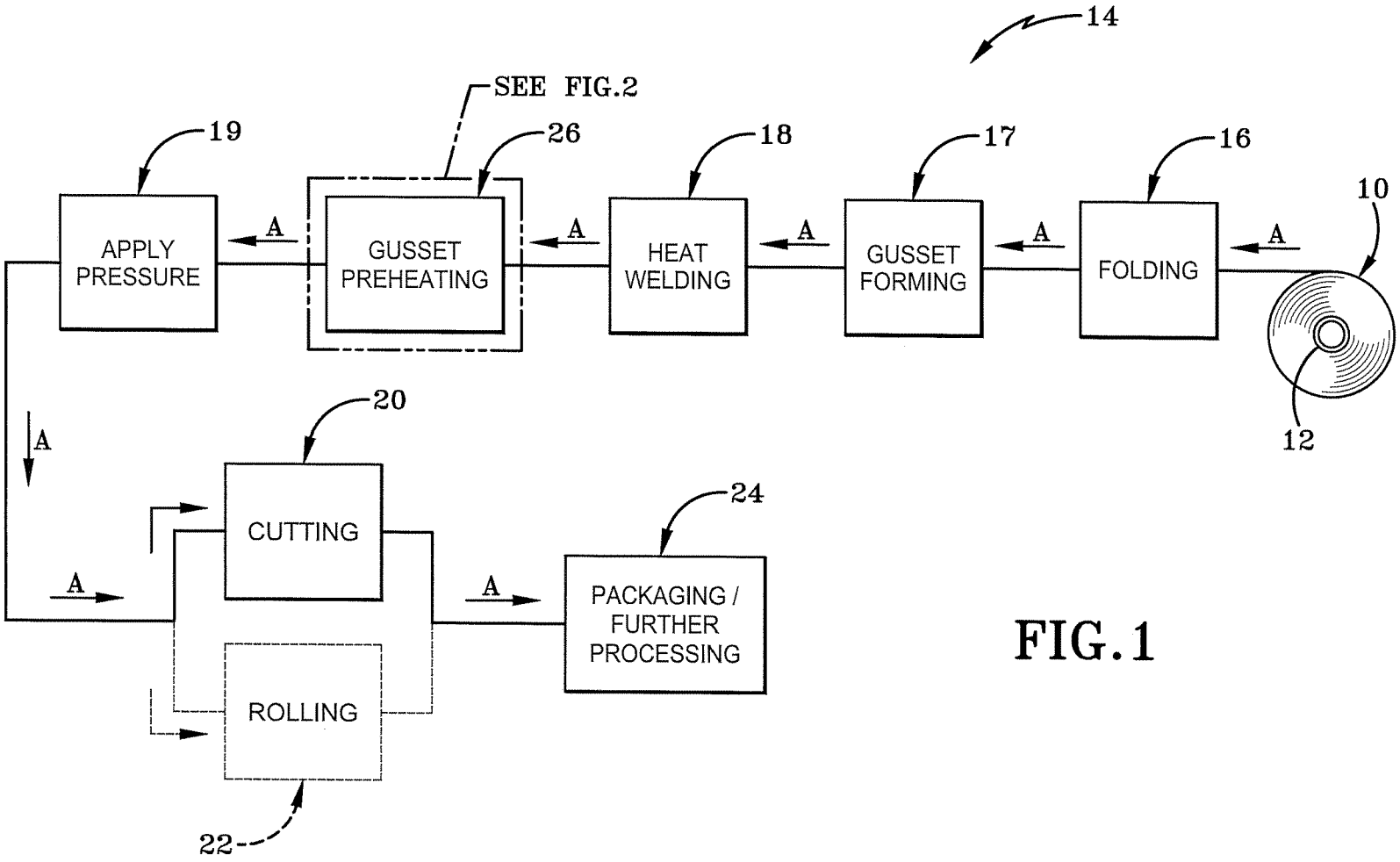
FIG. 1 is a schematic representation of a portion of a process or system for forming a roll or stack of gusseted polypropylene bags.

Referring to FIGS. 1-10B there is disclosed part of a system for forming polypropylene bags, particularly gusseted polypropylene bags. The part of the system shown herein relates to the portion of the process after the polypropylene granules have been melted and extruded into threads, they are woven and laminated to form a polypropylene sheet that has been wound into a roll around a spindle. FIG. 1 shows an elongate sheet 10 of polypropylene wound around a spindle 12 to form a roll of polypropylene.

Sheet 10 is progressively wound off spindle 12 and travels through a process 14 in the direction of arrow "A" (FIG. 1). Process 14 may include a variety of steps that include but not limited to folding 16 regions of the sheet 10 as it feeds off spindle 12 and thereby forming gussets 17, heat welding 18 one or more seams in the sheet, cutting 20 individual bags from the sheet or rolling 22 the uncut individual bags onto a second roll and ultimately packaging or further processing 24 of the cut or rolled bags. The cutting operation 20 may also include simultaneous welding of a bottom seam on the individual bags. The order of some of the steps set out above may be changed, depending on the type of bag that is being produced.

It will be understood that additional steps to those discussed above may be undertaken during fabrication of the individual bags. Such additional steps may include but are not limited to heat welding a bottom seam or side seams or other seams prior to the cutting operation 20 or rolling operation 22; printing on the sheet 10 either before or after the individual bags are formed; cutting apertures for handles, applying zipper mechanisms etc. It should be noted that the steps of folding 16, heat welding 18, forming gussets 17, cutting individual bags 20 or rolling 22 the uncut bags onto a second roll, and the step of packaging 24 or further processing of the cut or rolled bags is known in the art.

Process 14 as illustrated in FIG. 1, however, includes one additional step that is unknown in the art. This additional step is represented in FIG. 1 by the reference number 26 and comprises the steps of preheating the gussets formed in the sheet 10 and then applying pressure 19 (FIG. 1) to the preheated sheet 10. The preheating step 26 is performed on a gusset preheating assembly 28 that is illustrated in FIGS. 2-9. Gusset preheating assembly 28 and its method of use is described below.

Figure 4:
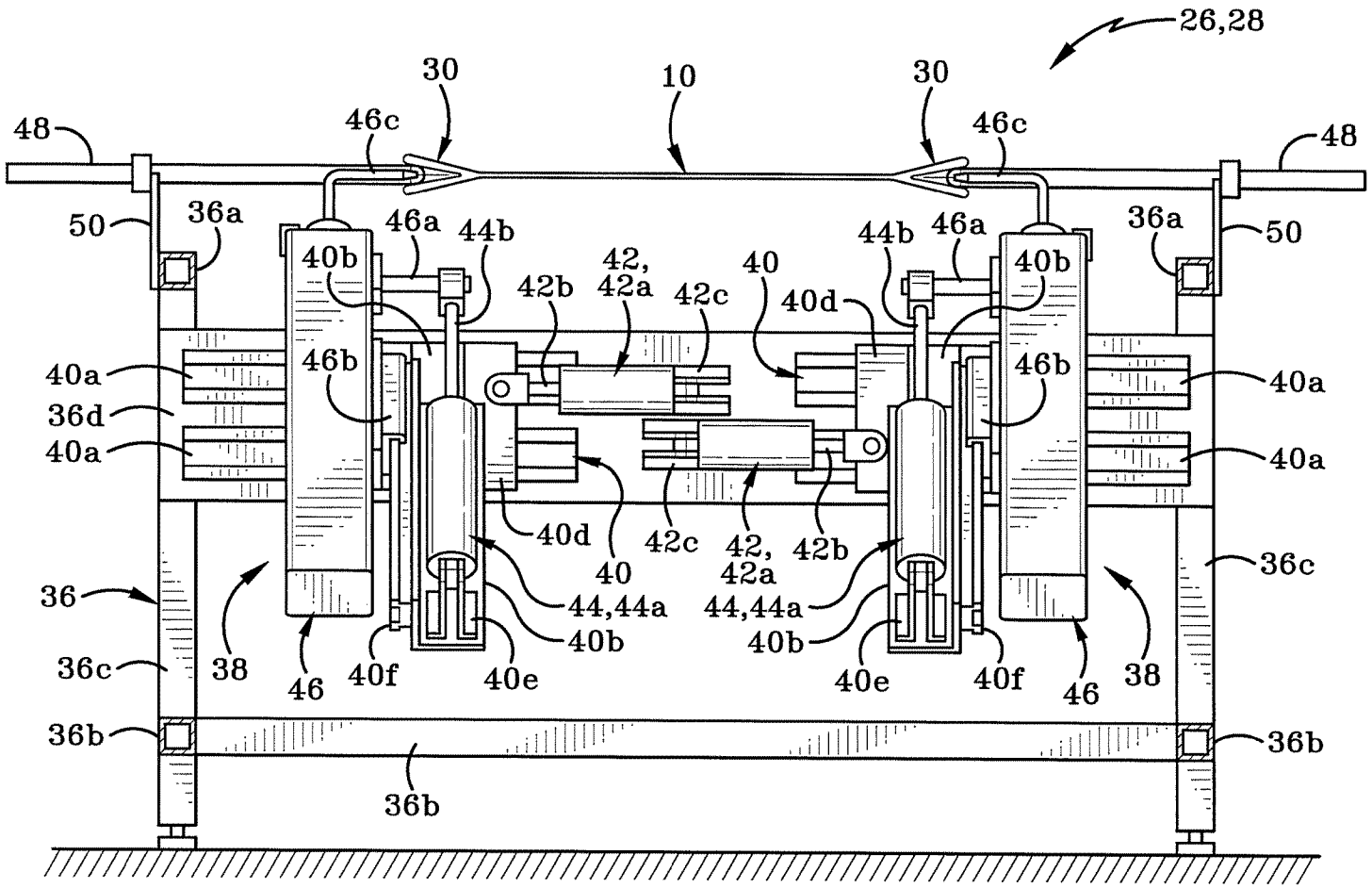
FIG. 4 is a front elevation view of the gusset preheating assembly.
Figure 7:
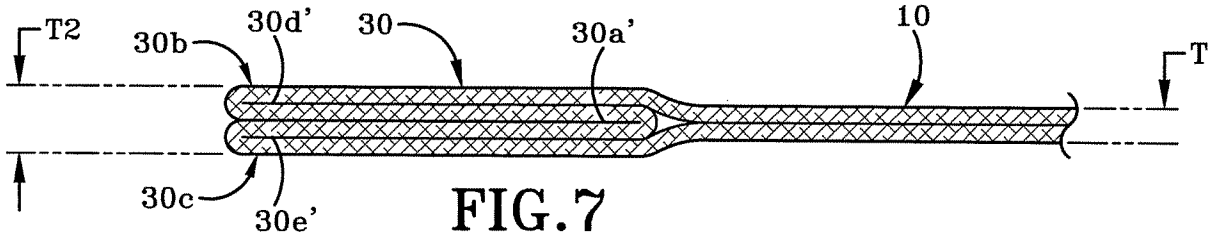
FIG. 7 is a cross-sectional view of one gusset on the polypropylene sheet shown after passing through the gusset preheating assembly and after being heated; with the cross-section taken along line 7-7 of FIG. 2.
Figure 8:
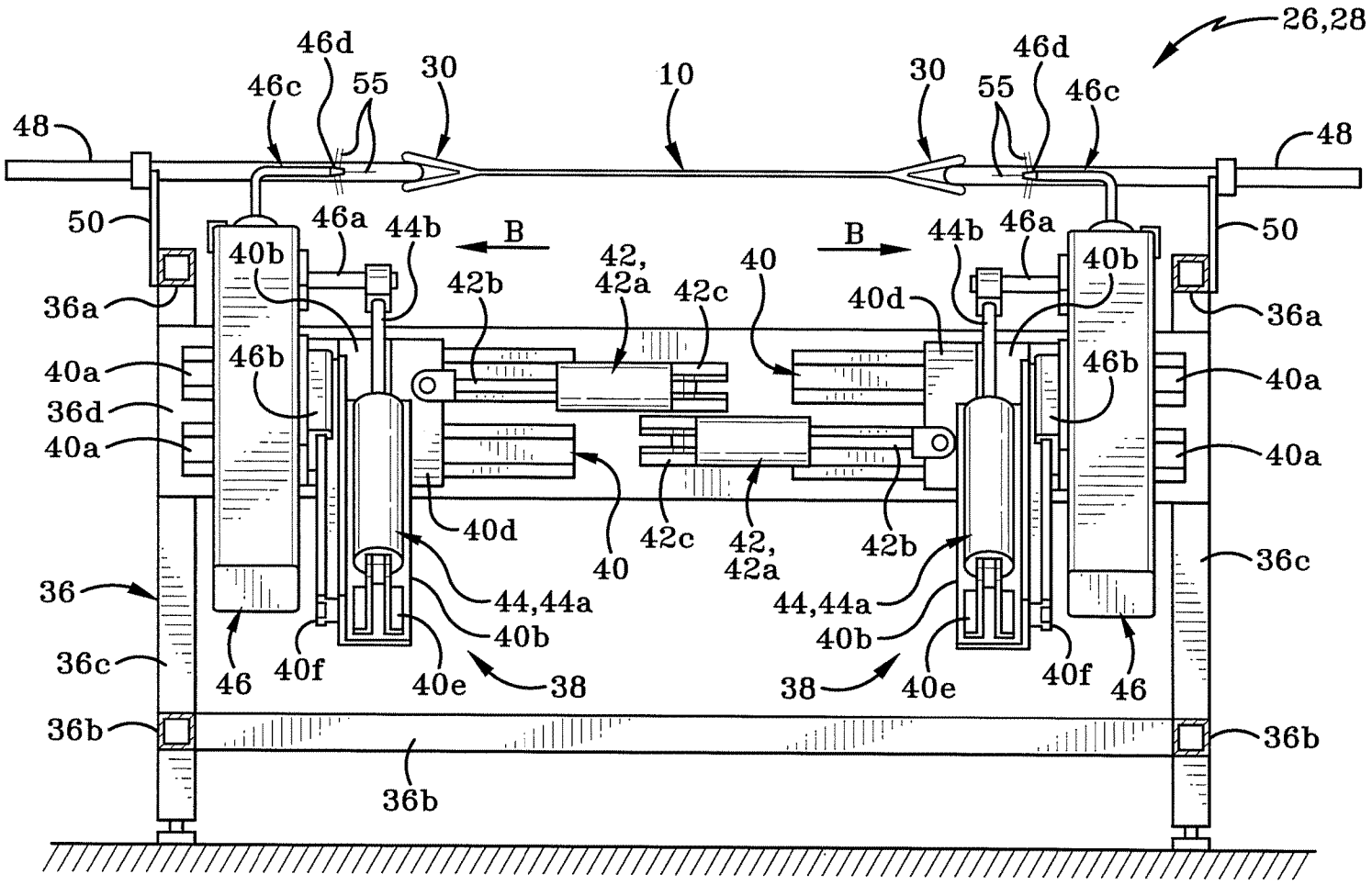
FIG. 8 is a front elevational view of the gusset preheating assembly when a horizontal hydraulic system on the assembly is actuated.
Figure 9:
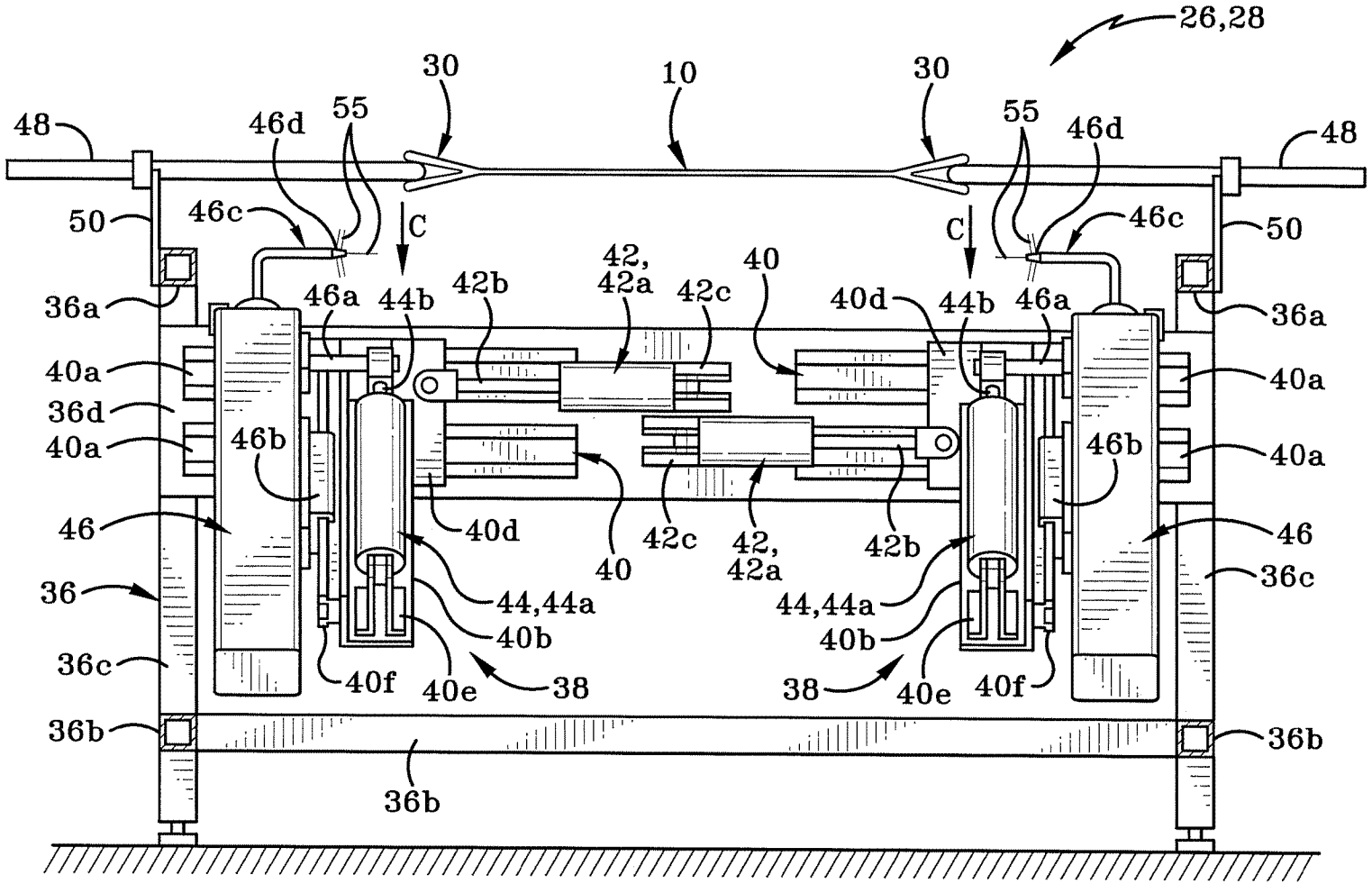
FIG. 9 is a front elevational view of the gusset preheating assembly when a vertical hydraulic system on the assembly is actuated.

In the process 14 depicted in FIG. 1, polypropylene sheet 10 is initially wound onto spindle 12. As process 14 begins, a length of the polypropylene sheet 10 unwinds from spindle 12 and is moved through the folding process 16, a heat welding process 18 and a gusset forming process 17. In the gusset forming process 17 a wheel may engage each side of sheet 10 and form a fold or gusset 30 (FIGS. 5-7) therein. The two gussets 30 so formed are depicted in FIGS. 4, 8 and 9 and one of the gussets 30 is shown in greater detail in FIGS. 5-7. The gusseted sheet is fed into preheating assembly 28 and the process that occurs therein will be further described below. Sheet 10 passing out of preheating assembly 28 either moves into cutting operation 20 where separate, individual bags are cut off the length of the sheet and are stacked one on top of the other in a stack that may be placed in a box (or some other container), as depicted in FIG. 10B by the reference number 32. Alternatively, individual bags may remain connected to each other and therefore remain as part of sheet 10 moving through process 14. These still-connected individual bags may be rolled onto another roll, identified in FIG. 10B by reference number 34. The packaged 24 box 32 or roll 34 may be sent on to a customer or may be sent within the same plant for further processing.

Figure 2:
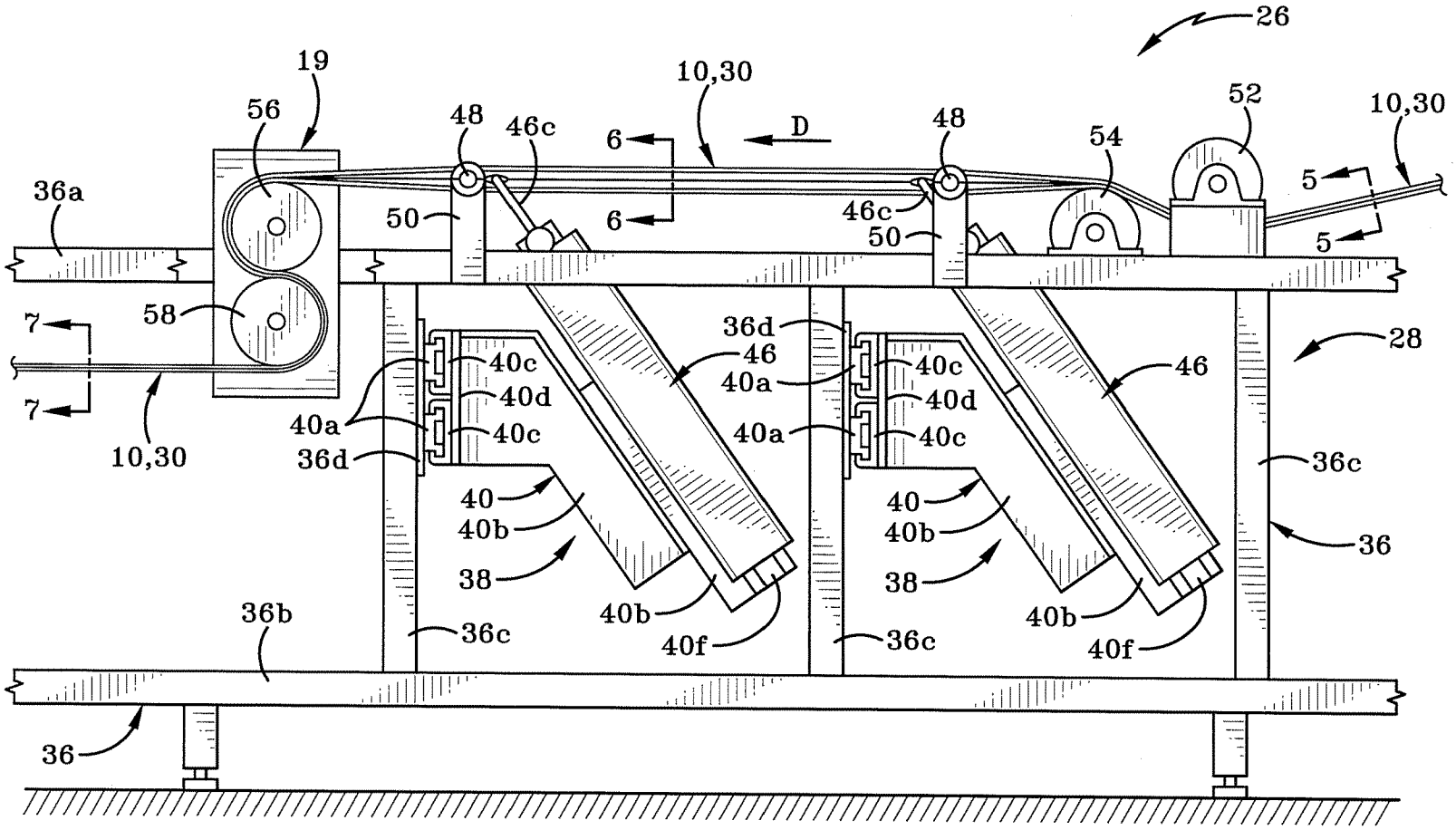
FIG. 2 is a side elevation view of a gusset preheating assembly that comprises part of the system of FIG. 1.

As shown in FIG. 2, preheating assembly 28 comprises a frame 36 made up at least from a plurality of spaced-apart horizontal frame members 36*a*, 36*b* and a plurality of spaced-apart vertical frame members 36*c*; and a plurality of cross-plates 36*d* (FIG. 4).

Figure 3:
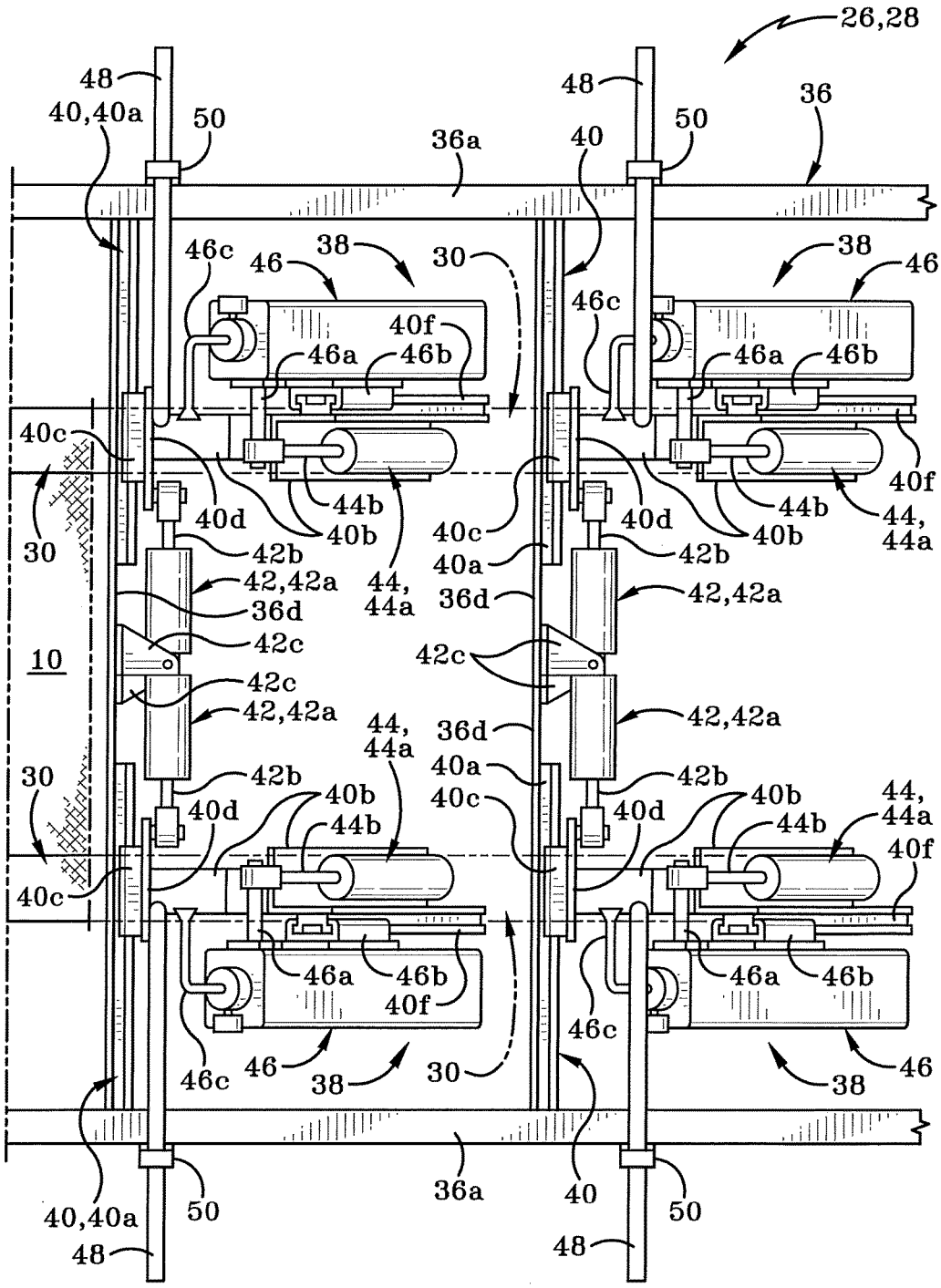
FIG. 3 is a top plan view of the gusset preheating assembly of FIG. 2.

At least two heating gun assemblies 38 are mounted on frame 36. Gun assemblies 38 may be laterally aligned with each other and are spaced laterally apart from each other. As shown in FIGS. 3 and 4, each heating gun assembly 38 includes a mounting assembly 40, a first hydraulic member 42 and a second hydraulic member 44. (First hydraulic member 42 and second hydraulic member 44 are oriented at right angles to each other and are operable to move at least a portion of heating gun assembly 38 in directions that are at right angles to each other, as will be later described herein.)

Mounting assembly 40 includes two pairs of laterally and vertically spaced-apart guide tracks 40*a* that are fixedly secured to cross-plates 36*d*, one pair of guide tracks 40*a* for each heating gun assembly 38. Each track may be substantially U-shaped in cross-section. Mounting assembly 40 further includes a housing 40*b* that has a corresponding number of rails 40*c* provided on a rear wall 40*d* (FIG. 3) thereof. Each rail 40*c* is shaped, sized and arranged to be complementary to and interlockingly engaged with one of tracks 40*a*. This can be seen in FIG. 2. The engagement between rails 40*c* and tracks 40*a* is such that rails 40*c* are able to slide along tracks 40*a* when a force is applied thereto, as will be described hereafter.

Each first hydraulic member 42 includes a cylinder 42*a* and a piston 42*b* that are engaged with each other as shown in FIG. 3. One end of each cylinder 42*a* is pivotally anchored to a bracket 42*c* mounted on cross-plate 36*d* and one end of each piston 42*b* is pivotally anchored to rear wall 40*d* of a different one of the housings 40*b*. When first hydraulic members 42 are activated such that pistons 42*b* are extended outwardly from the associated cylinders in the direction of arrow "B" (as is shown in FIG. 8), a force is brought to bear upon the associated rear wall 40*d* by the activated first hydraulic members 42. Rear wall 40*d* is thereby caused to slide along horizontally-oriented tracks 40*a* in the direction of arrow "B". When pistons 42*b* are retracted into cylinders 42*a*, the associated rear walls 40*d* will be drawn toward the anchored cylinders 42*a* in the opposite direction of arrow "B". Because of the orientation of tracks 40*a* and first hydraulic members 42, the movements of housings 40*b* in response to activation of first hydraulic members 42 are movements in a horizontal or lateral orientation.

Each second hydraulic member 44 includes a cylinder 44*a* and a piston 44*b* that are engaged with each other as shown in FIG. 3, One end of each cylinder 44*a* is engaged by way of a mounting bracket 40*e* (FIG. 4) with an angled wall of housing 40*b*. The end of piston 44*b* remote from its associated cylinder 44*a* is engaged with one of a plurality of heating guns 46 via a mounting 46*a* (FIG. 4). A vertically-oriented guide track 40*f* is provided along a side of housing 40*b* adjacent heating gun 46 and a cooperating and complementary rail 46*b* is provided on heating gun 46. Track 40*f* and rail 46*b* interlock in such a way that heating gun 46 is able to slide relative to housing 40*b*. This sliding motion is generated by activation of second hydraulic member 44. If piston 44*b* is retracted inwardly into cylinder 44*a* in the direction of arrow "C" (FIG. 9), the heating gun 46 slides along guide track 40*f* in the direction of arrow "C". If piston 44*b* is extended outwardly from cylinder 44*a* in the opposite direction of arrow "C", then a force is exerted on or is brought to bear upon heating gun 46 by second hydraulic members 44 and heating gun 46 slides along guide track 40*f* in the opposite direction to arrow "C". This motion of heating gun 46 in the direction of arrow "C" is a vertically oriented motion. Thus, first hydraulic members 42 are capable of moving housing 40*b* and therefore the heating gun 46 interlocked with housing 40*b*, in a generally horizontal orientation. Second hydraulic members 44 are capable of moving housing 40*b* and therefore heating gun 46 in a generally vertical orientation.

A nozzle 46*c* extends outwardly from an uppermost end of each heating gun 46. This is shown in FIG. 9 and FIG. 4. Nozzle 46*c* moves in unison with heating gun 46. Consequently, as heating gun 46 is moved horizontally (in the direction of arrow "B" or in the direction opposite to arrow "B") or vertically (in the direction of arrow "C" or in the direction opposite to arrow "C"), nozzle 46*c* is moved in like manner.

Figure 5:
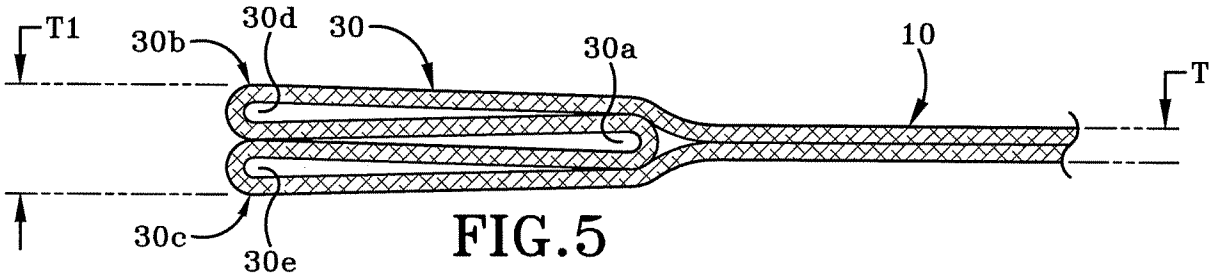
FIG. 5 is a cross-sectional view of one gusset on a polypropylene sheet prior to passing through the gusset preheating assembly for preheating, with the cross-section taken along line 5-5 of FIG. 2.
Figure 6:
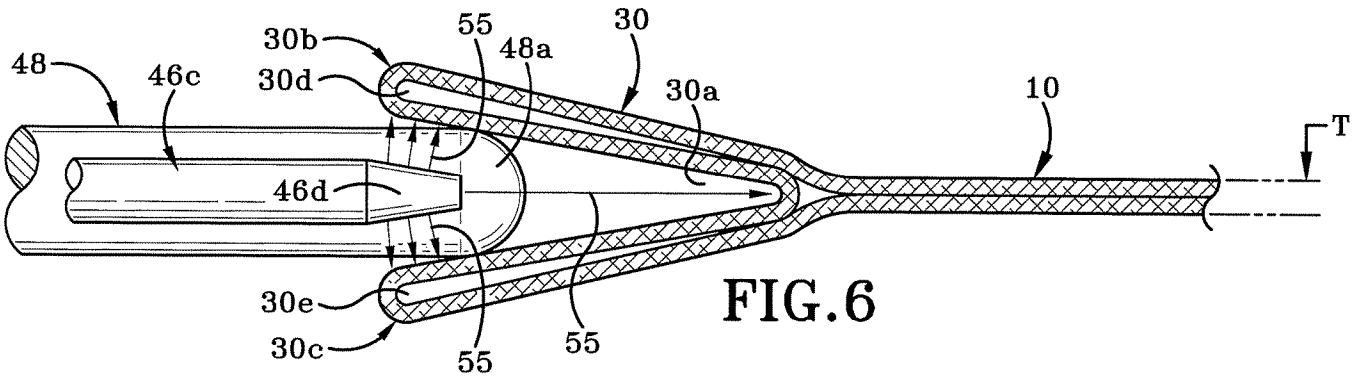
FIG. 6 is a cross-sectional view of one gusset on the polypropylene sheet shown during gusset heating, with the cross-section taken along line 6-6 of FIG. 2.

As shown in FIGS. 5-6, when gusset preheating assembly 28 is to be used during a production run, the nozzle 46*c* is moved horizontally and vertically into a position where the nozzle 46*c* is in the correct position for blowing heated air into gap 30*a* defined between the folded layers 30*b* and 30*c* of gusset 30. Heated air is also blown from nozzle 46*c* toward the folded ends of layers 30*b* and 30*c*. The folded end of layer 30*b* defines a gap 30*d* therein and the folded end of layer 30*c* defines a gap 30*e* therein. When the run is completed, nozzle 46*c* is retracted so that it will not come into contact with sheet 10 and melt the same.

A plurality of spreader rods 48 are mounted on each side of frame 36 by mounting brackets 50. Each rod 48 is positioned adjacent one of the heating gun assemblies 38 and may be positioned close to where one of the nozzles 46*c* will be located when that associated nozzle 46*c* is moved upwardly (in the direction opposite to arrow "C") and inwardly (in the opposite direction to arrow A"). Rods 48 may have a hemispherical tip 48*a* (FIG. 6) that has a diameter that is equal to or greater than a diameter of nozzle 46*c*. Tip 48*a* and rod 48 therefore expands or increases the size of the gap 30*a* defined in gusset 30 so that nozzle 46*c* is able to be inserted into gap 30*a* or removed from gap 30*a* without coming into contact with the layers of sheet 10 that have been folded to form gusset 30. Rods 48 thus permit the insertion of nozzles 46*c* into gap 30*a*.

A plurality of feed rollers 52, 54, and press-rollers 56, 58 is mounted on frame 36. Sheet 10 is fed through rollers 52-58 in the manner illustrated in FIG. 2. The direction of the feed is identified by arrow "D" in FIG. 2. FIG. 5 shows that prior to being fed through feed roller 52, sheet 10 includes a gusset 30 (at either end—but only one end is shown in this figure). The maximum thickness of the gusset 30 is indicated as thickness "T1" and thickness "T1" is substantially greater than the thickness "T" of the central region of sheet 10.

After being fed over roller 54, both gussets 30 are spread open and kept open by the first spreader rods 48 that are positioned opposite each other across the width of sheet 10. Because of the gentle curvature of tip 48*a* of spreader rod 48, sheet 10 is not torn or otherwise damaged by engaging tip 48*a*. Immediately after being spread open by the spreader rod 48 closest to feed roller 54, nozzle 46*c* is introduced into the gap 30*a* (FIG. 6) created in gusset 30 by spreader rod 48. Heating gun 46 and thereby nozzle 46*c* is raised vertically by activating second hydraulic members 44 and is moved horizontally inwardly into the gap 30*a* defined by the spread-apart gusset 30 by activating the first hydraulic members 42. (It should be noted that the system for moving the heating gun assemblies, particularly for moving the nozzles thereon, may be omitted and the nozzle may remain in a fixed position relative to the frame during processing of the bags.)

Once tip 46*d* of nozzle 46*c* is physically located in the gap 30*a*, air flowing through heating gun assembly 40 is heated and then this heated air 55 is blown into gap 30*a* by nozzle 46*c* and is directed toward the folded ends of layers 30*b*, 30*c* where gaps 30*d* and 30*e*, respectively, are defined. The heat from the heated air 55 warms layers 30*b*, 30*c* and the gaps 30*a*, 30*d*, 30*e*. The air may be heated by heating gun assembly 28 to a temperature of around 400° C.; this temperature being sufficient to warm but not melt the polypropylene layers 30*b*, 30*c*. As the sheet continues to move through the process, a second blast of hot air may be introduced into gap 30*a* by the second nozzle 46*c* on the same side of gusset preheating assembly 28, i.e., that second nozzle being the nozzle closest to the second spreader rod 48 and the press rollers 56, 58.

It should be noted that each nozzle 46*c* may be located before or after the associated spreader rod 48; whichever position is most desirable. It will also be understood that only a single nozzle 46*c* and associated heating gun 46, may be provided along one side of gusset preheating assembly 28 or two or more nozzles 46*c* with associated heating gun assemblies 46 may be provided on each side of gusset preheating assembly 28. Additionally, only one spreader rod 48 may be utilized on each side of gusset preheating assembly 28 or two or more such spreader rods 38 may be provided on each side of assembly 28.

After being fed past the second spreader rod 48, the gusset 30 is no longer held open by any additional spreader rods 48 and the gusset 30 tends to relax and cool. The relaxation of gusset 30 may tend to make the folded layers 30*b*, 30*c* of the gusset 30 collapse inwardly toward each other. The sheet 10 cools and is passed through S-wrap press rollers 56, 58. Rollers 46, 58 are positioned and configured to apply pressure 19 (FIG. 1) to the sheet 10. This application of pressure causes the gaps 30*a*, 30*d*, 30*e* between and in the heated layers 30*b*, 30*c* to collapse and become reduced in size. As shown in FIGS. 5 and 7, the gap 30*a* may be reduced to gap 30*a*', the gap 30*d* may be reduced to gap 30*d*' and the gap 30*e* may be reduced to gap 30*e*'. The gaps 30*a*, 30*d*, 30*e* may therefore effectively disappear (see FIG. 7 from between the layers 30*b*, 30*c*. The folds in the gusset 30 consequently become less rounded and open and, instead the folds or creases in gusset 30 become crisper or sharper than would be possible if sheet 10 was not passed through gusset preheating assembly 26 (FIG. 1). After passing through press rollers 56, 58, the gusset 30 can be seen to have a maximum thickness indicated by the reference character "T2" in FIG. 7. This thickness "T2" is relatively comparable to the thickness "T" of the central part of sheet 10 and is much thinner than the thickness "T1" prior to entering preheating assembly 28. The sheet is subsequently fed into a cutting and stacking process 20 (FIG. 1) or is fed into a rolling operation 22. After cutting 20 or rolling 22, the bags formed from sheet 10 may be packaged or further processed 24 as indicated in FIG. 1.

Figure 10A:
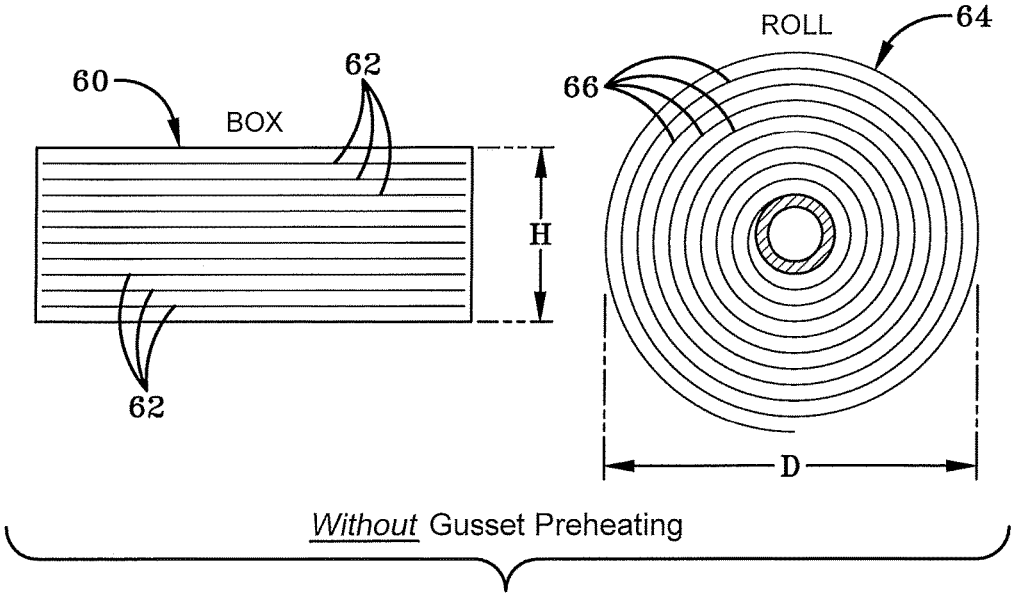
FIG.10A PRIOR ART
FIG. 10A is a schematic view of a stack of gusseted polypropylene bags and a roll of gusseted polypropylene bags where the bags have not passed through the gusset preheating assembly in accordance with an aspect of the present invention.
Figure 10B:
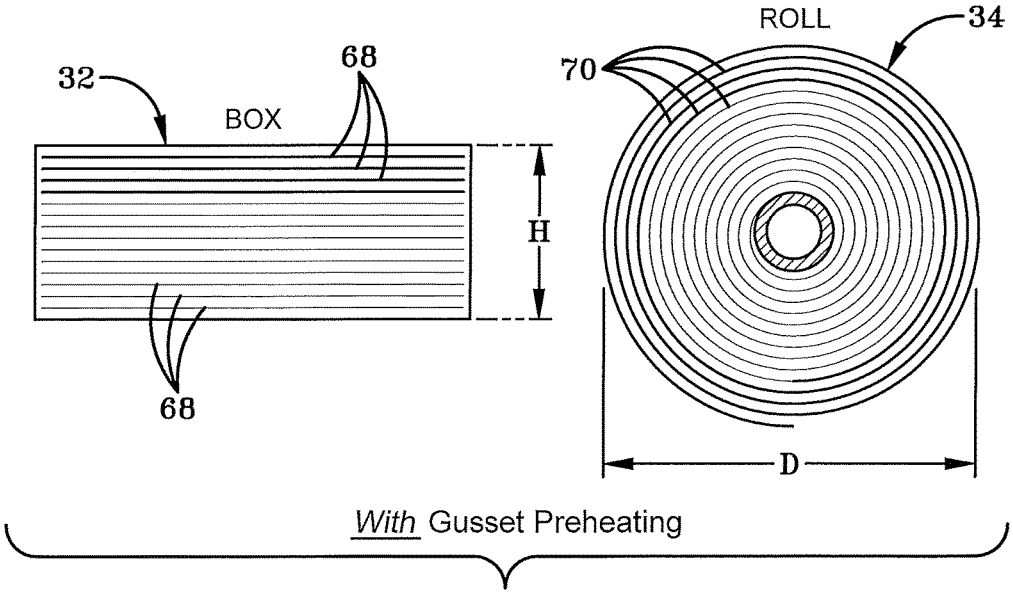
FIG. 10B is a schematic view of a stack of gussets polypropylene bags and a roll of gusseted polypropylene bag where the bags have passed through the gusset preheating assembly in accordance with an aspect of the present invention.

FIG. 10A shows a box 60 that schematically illustrates a plurality of bags 62 stacked one on top of the other inside box 60 and where the total height of the stack is indicated by the reference number "H". Bags 62 are used to illustrate a number of bags that have not passed through preheating assembly 28. Similarly, a roll that has not passed through preheating assembly 28 is shown schematically in FIG. 10A and is identified by the reference number 64. Roll 64 is illustrated as having a diameter "D" and has several layers 66 of gusseted sheet rolled thereon.

FIG. 10B shows a box 32 that schematically illustrates a plurality of bags 68 stacked one on top of the other in a box 32. Even though the height of the box 32 is the same height "H" as in FIG. 10A the number of bags 68 inside the box 32 has increased dramatically relative to the number of bags 62 in box 60. The reason for the increased number of bags 68 in box 32 is that these bags 68 went through preheating assembly 28 and the thickness of the gussets 30 on these bags 68 has been reduced from the thickness "T1" (FIG. 5) to the thickness "T2" in FIG. 7. Similarly, roll 34 illustrates a scenario where sheet 10 has been treated in preheating assembly 28. The resultant roll 34 is of the same diameter "D" as roll 64 but there are substantially more layers 70 of sheet wound onto roll 34 than was the case with roll 64.

It has been found that by passing sheet 10 through preheating assembly 28 to decrease the thickness and stiffness of gussets 30 thereon, about 40% more bags 68 may be stacked in a stack or box 32 relative to sheet that has not passed through preheating assembly 28. Similarly, about 40% more sheet layers 70 may be wound onto a roll 34 relative to a sheet that has not passed through a preheating assembly 28. It is therefore possible to package about 40% more bags or layers in the same box or on the same roll than was possible before the development of preheating assembly 28 and the process of utilizing the same.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A method of producing plastic bags, said method comprising:

forming a gusset in each of two opposing sides of a plastic sheet, wherein each gusset includes a first folded layer and a second folded layer of plastic and the first folded layer is separated from the second folded layer by a gap;

passing the gusseted sheet into a gusset preheating assembly;

introducing a nozzle of a heating gun assembly into the gap;

blowing hot air into the gap from the nozzle;

heating the first folded layer and second folded layer with the hot air to a temperature that is sufficient to warm but not melt the plastic thereof;

removing the heating gun assembly from the gap;

relaxing the gusset;

applying pressure to the relaxed gusset;

causing the gap to collapse and become reduced in size, wherein the heat and pressure is insufficient to seal the first folded layer and the second folded layer to each other; and feeding the sheet with the relaxed gussets into a cutting operation or into a rolling operation.

2. The method as defined in claim 1, wherein the application of pressure to the relaxed gussets occurs prior to feeding the sheet into the cutting operation or the rolling operation; and wherein the method further comprises the step of:

reducing a first gap between layers of the first folded layer; and reducing a second gap between layers of the second folded layer, where the first and second gaps were created during the step of forming the gussets in the plastic sheet.

3. The method as defined in claim 1, wherein the step of passing the gusseted sheet into the gusset preheating assembly includes the step of:

inserting a spreader rod into the gap defined between the first folded layer and the second folded layer of each gusset prior to introducing the nozzle of the heating gun assembly; and increasing a size of the gap between the first folded layer and the second folded layer using the spreader rod.

4. The method as defined in claim 1, wherein the step of inserting the nozzle includes the step of:

moving the heating gun assembly in a horizontal direction.

5. The method as defined in claim 4, wherein the step of moving the heating gun assembly is preceded by activating a first hydraulic member engaged with the heating gun assembly.

6. The method as defined in claim 5, where the step of moving the heating gun assembly in a horizontal direction further includes sliding the heating gun assembly along a horizontally oriented track under the influence of a force exerted by the activated first hydraulic member.

7. The method as defined in claim 1, wherein the step of introducing the nozzle includes the step of moving the heating gun assembly in a vertical direction.

8. The method as defined in claim 7, wherein the step of moving the heating gun assembly is preceded by activating a second hydraulic member engaged with the heating gun assembly.

9. The method as defined in claim 8, where the step of moving the heating gun assembly in the vertical direction further includes sliding the heating gun assembly along a vertically oriented track under the influence of a force exerted by the activated second hydraulic member.

* * * * *